US007850472B2

(12) United States Patent
Friedrich et al.

(10) Patent No.: US 7,850,472 B2
(45) Date of Patent: Dec. 14, 2010

(54) CONNECTOR ELEMENT

(75) Inventors: Juergen Friedrich, Halver (DE); Krystian Kawa, Luedenscheid (DE)

(73) Assignee: Techpointe S.A., Delemont (CH)

( * ) Notice: Subject to any disclaimer, the term of this patent is extended or adjusted under 35 U.S.C. 154(b) by 0 days.

(21) Appl. No.: 12/529,385

(22) PCT Filed: Feb. 22, 2008

(86) PCT No.: PCT/EP2008/052168

§ 371 (c)(1),
(2), (4) Date: Sep. 1, 2009

(87) PCT Pub. No.: WO2008/104506

PCT Pub. Date: Sep. 4, 2008

(65) Prior Publication Data

US 2010/0105235 A1 Apr. 29, 2010

(30) Foreign Application Priority Data

Mar. 1, 2007 (DE) ..... 10 2007 009 947

(51) Int. Cl.
*H01R 4/38* (2006.01)

(52) U.S. Cl. ..... 439/256

(58) Field of Classification Search ..... 439/256, 439/255, 257, 254, 320, 352
See application file for complete search history.

(56) References Cited

U.S. PATENT DOCUMENTS 2,719,876 A * 10/1955 Hennessey, Jr. et al. ... 174/77 R
3,452,316 A * 6/1969 Mocek et al. ..... 439/255
3,945,701 A * 3/1976 Boeke et al. ..... 439/281

(Continued)

FOREIGN PATENT DOCUMENTS

DE 198 14 334 A 10/1998
EP 1 603 200 XA 12/2005

*Primary Examiner*—T C Patel
*Assistant Examiner*—Vladimir Imas
(74) *Attorney, Agent, or Firm*—Lucas & Mercanti, LLP; Klaus P. Stoffel

(57) ABSTRACT

The invention relates to a connector element (1) of an electrical connector, comprising a contact carrier (3) that is provided with one or more electrical contacts (18), an actuation sleeve (4) which surrounds the contact carrier (3), and a threaded engaging part (7) that is provided with one or more engaging thread projections (5) which are to penetrate into a mating thread (6) of a mating connector element (2). The actuation sleeve (4) can be moved from a released position, in which the thread projections (5) do not engage into the mating thread (6) and the connector element (1) can be connected to the mating connector element (2), into a locked position, in which the thread projections (5) engage into the mating thread (6) and the connector element (1) is tied to the mating connector element (2). The engaging thread projections (5) are supported by spring tongues (8) which can be moved from the released position into the locked position by axially moving the actuation sleeve (4) against the spring bias thereof. The spring tongues (8) are monolithically molded onto a spring tongue support (9) that annularly surrounds the contact carrier (3). The threaded engaging part (7) is made of plastic and forms a mating catching means (12) that cooperates with a catching means (13) of the actuation sleeve (4) in order to lock the actuation sleeve (4) into place in both the released position and the locked position.

10 Claims, 12 Drawing Sheets

Figure 1:
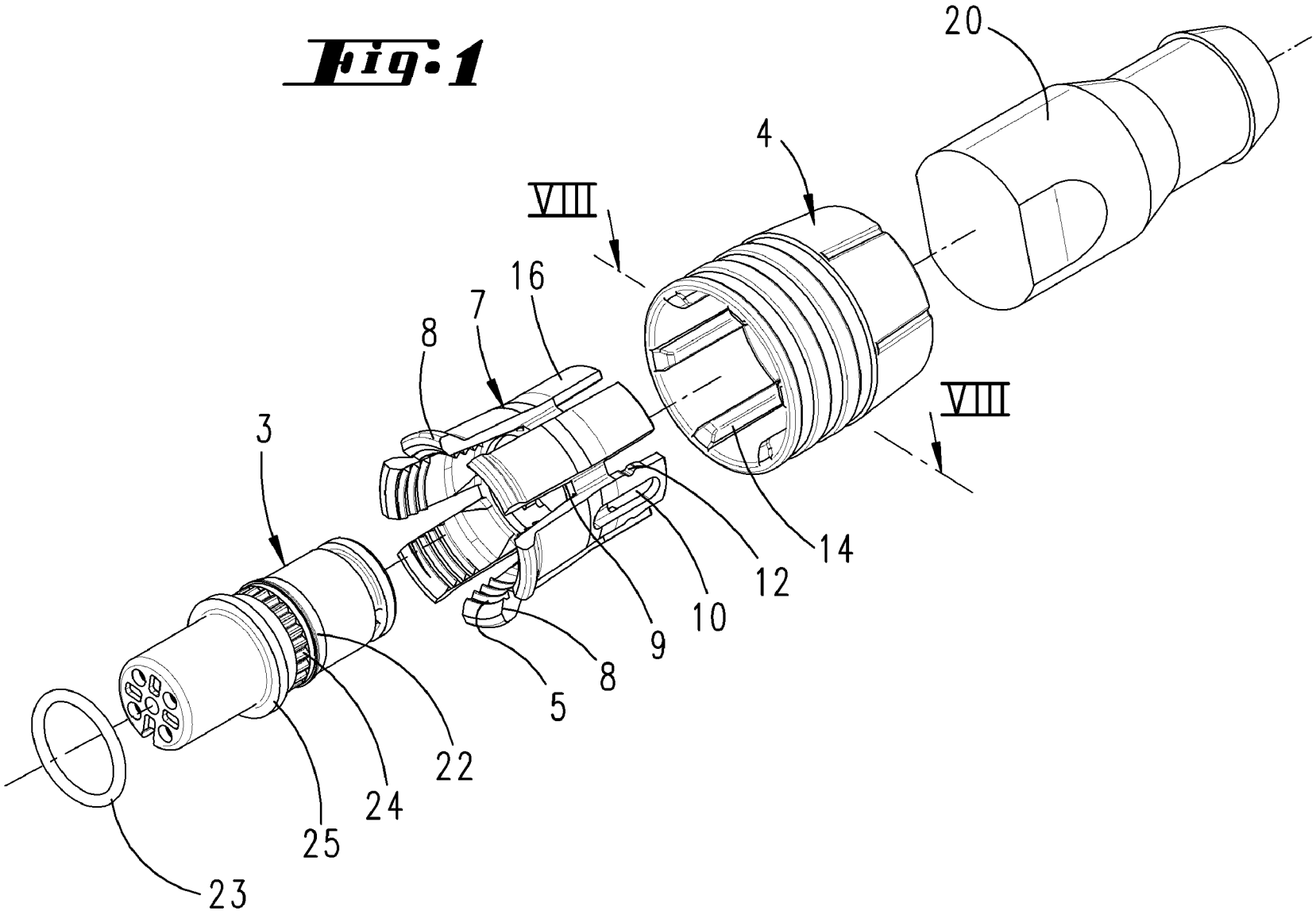

U.S. PATENT DOCUMENTS 4,919,627 A * 4/1990 Cable ..... 439/263
4,941,846 A * 7/1990 Guimond et al. ..... 439/578
5,468,161 A * 11/1995 Wright ..... 439/607.5
5,514,001 A * 5/1996 Szegda ..... 439/263
5,785,545 A * 7/1998 Holt ..... 439/352
6,149,455 A * 11/2000 Levi ..... 439/462
6,162,082 A * 12/2000 Karsten et al. ..... 439/318
6,267,612 B1 * 7/2001 Arcykiewicz et al. ..... 439/253
6,280,229 B1 * 8/2001 Harting et al. ..... 439/393
6,619,876 B2 * 9/2003 Vaitkus et al. ..... 403/349
6,749,454 B2 * 6/2004 Schmidt et al. ..... 439/350
6,769,926 B1 * 8/2004 Montena ..... 439/253
6,848,931 B2 * 2/2005 McMullen et al. ..... 439/350
6,884,105 B2 * 4/2005 Turck et al. ..... 439/352
7,165,987 B2 * 1/2007 Kim et al. ..... 439/271
7,309,255 B2 * 12/2007 Rodrigues ..... 439/578
7,364,450 B2 * 4/2008 Hafner et al. ..... 439/255
7,566,236 B2 * 7/2009 Malloy et al. ..... 439/321
7,568,934 B1 * 8/2009 Williams et al. ..... 439/271
7,682,177 B2 * 3/2010 Berthet ..... 439/321
2004/0198087 A1 * 10/2004 Lin ..... 439/321
2005/0153591 A1 * 7/2005 Milner et al. ..... 439/321
2005/0208812 A1 * 9/2005 Gaidosch ..... 439/320
2006/0033218 A1 2/2006 Hafner et al.
2006/0172580 A1 * 8/2006 Scholler et al. ..... 439/321
2009/0264003 A1 * 10/2009 Hertzler et al. ..... 439/299
2010/0029118 A1 * 2/2010 Yang et al. ..... 439/321
2010/0099290 A1 * 4/2010 Gastineau ..... 439/321

* cited by examiner 20
12
13
12
26
7
5
8
3
30
29
28
8
34
5
29
30
12
32
12
13
4
28
8
5

XIV
XIII
3
4
26
34
XIV
XIII

XII
1
20

26
27
8
45
45
29
34
30
29
5
3
28
7
4

CONNECTOR ELEMENT

This application is a 371 of PCT/EP2008/052168 filed Feb. 22, 2008, which in turn claims the priority of DE 10 2007 009 947.0 filed Mar. 1, 2007, the priority of both applications is hereby claimed and both applications are incorporated by reference herein.

The invention relates to a connector element of an electrical plug-in connection having a contact carrier which has one or more electrical contacts, an actuating sleeve which surrounds the contact carrier, and having a thread engagement part having one or more thread engagement projections for entry into a mating thread of a mating connector element, it being possible to move the actuating sleeve from a released position, in which the thread projections do not engage in the mating thread and the connector element can be connected to the mating connector element, into a locked position, in which the thread projections engage in the mating thread and the connector element is secured to the mating connector element.

DE 10 2004 028 060 A1 discloses various embodiments of a connector element which can be connected to a mating connector element. By virtue of subsequent axial displacement of an actuating sleeve, thread engagement projections are moved into a mating thread of a mating connector element. A seal in the form of a sealing ring can be compressed by virtue of subsequent twisting of the actuating sleeve. The thread engagement projections are carried there by spring tongues which are displaced from the released position into the locked position by axial displacement of the actuating sleeve against its spring stress. The spring tongues are integrally formed on a spring tongue carrier, which annularly surrounds the contact carrier, and consist of metal.

DE 198 14 334 A1 discloses a connector which can be connected to a mating connector element in the course of quick-action locking. In this case also, spring tongues are displaced substantially radially with respect to the axis of the connector element by actuation of an actuating sleeve. Locking projections enter associated locking grooves.

It is an object of the invention to develop a connector element of the generic type, which is able to displace thread engagement projections into the turns of a mating thread by axial displacement of an actuating sleeve, in a way which enhances its usability.

The object is achieved by the invention specified in the claims, each claim representing an independent solution to the problem and it being possible to combine each claim with any other claim as desired.

First and foremost, provision is made for the thread engagement part to comprise a plastics material. As a result, simple production in terms of shaping is possible. Not only the actuating sleeve and the contact carrier, but also the thread engagement part can be produced using an injection-molding process. Provision is also made for the actuating sleeve to be held in its two operating positions by latching means. The latching means interact with corresponding mating latching means of the thread engagement part. In a development of the invention, provision is made for the latching means to be in the form of a lug which projects radially inward from the inner wall of the actuating sleeve. This lug can be integrally formed on a guide rib. The mating latching means can be formed by a latching cutout. This latching cutout is preferably situated at the outer edge of a spring tongue or a rearward projection of the spring tongue. A rearward projection of this type can be formed by a push-in projection which lies in a plug-in passage in the actuating sleeve. Each of the total of preferably six spring tongues preferably continues rearward so as to form a push-in projection which is inserted into a corresponding plug-in passage in the actuating sleeve. The push-in projections can project from an annular spring tongue carrier, as for the spring tongues. In a development of the invention, which has independent importance, the actuating sleeve has actuating arms. These actuating arms project axially from the actuating sleeve. Lifting surfaces are disposed at the ends of the actuating arms. The lifting surfaces may be wedge surfaces. Said wedge surfaces engage beneath the thread engagement projections at several circumferential points in order to move said thread engagement projections into the thread engagement position when the actuating sleeve is displaced. The thread engagement projections are displaced in the radial direction in the process. At least three actuating arms which are uniformly distributed in the circumferential direction are preferably provided. These actuating arms may be disposed between the spring tongues which have, at their free ends, the thread engagement projections. The thread engagement projections can be formed by arcuate pieces. These arcuate pieces in each case partially surround the contact carrier in the circumferential direction. The arcuate pieces are preferably spaced apart from one another in the circumferential direction and form lateral protrusions with respect to the spring tongues. The lifting surfaces which are inclined in the manner of a wedge can engage beneath these protrusions when the actuating sleeve is displaced in the axial direction from the released position and the locked position. The thread engagement projections then slide on the inclined lifting surfaces in order to be radially displaced either outward or inward. Furthermore, the actuating arms can form wedge pieces which slide between the arcuate pieces when the actuating sleeve is displaced, in order to displace said arcuate pieces so as to increase the circumference or in order to stabilize the position. However, the actuating sleeve is associated with the spring tongue carrier in a rotationally fixed but axially displaceable manner. The spring tongue carrier can be associated only rotatably with the contact carrier. As a result of this configuration, the connector element can be plug-connected to a mating connector element in the released position. The connector element may be a male or female connector. If the two connector elements are plug-connected, the actuating sleeve is displaced in the axial direction. This results in the thread engagement projections moving in the radial direction in the direction of the mating thread. In this case, it is possible, depending on the design of the connector element, for said thread engagement projections to be displaced either radially outward in order to enter an internal thread of the mating connector element, or they can be displaced radially inward in order to be able, to engage in an external thread of the plug element. During this displacement, the actuating sleeve is released from a first latching position, in which it is held in the released position, and enters a second latching position, in which it is held in the locked position and in which the thread engagement projections lie in the turns of the mating thread. Subsequent rotation of the actuating sleeve carries along the thread engagement part and therefore the thread engagement projections. A sealing ring which is situated between connector element and connector element is compressed in the process of this screwing movement. In a development which has independent status, the thread engagement projection is formed by a plurality of helical turns of a helical spring. The helical spring can be located in the end region of the contact carrier. Recessed retaining grooves into which the helical spring is inserted are located there. The helical spring forms a radially displaceable thread. The retaining grooves are interrupted by intermediate spaces in the circumferential direction. The actuating arms of the actuating sleeve can engage in these intermediate spaces. The end faces of the actuating arms are beveled. These bevels can engage beneath the turns of the helical spring in order to space them apart in the radial direction. The helical turns of the spring then disengage from the retaining grooves in order to enter the turns of the mating thread.

Figure 2:
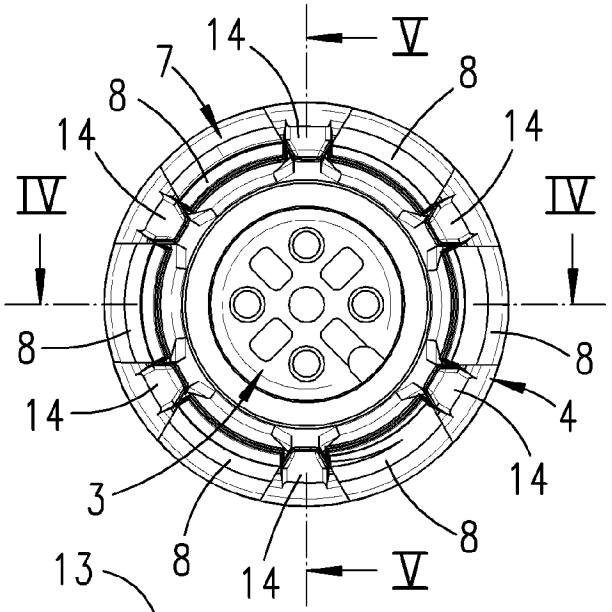
Figure 3:
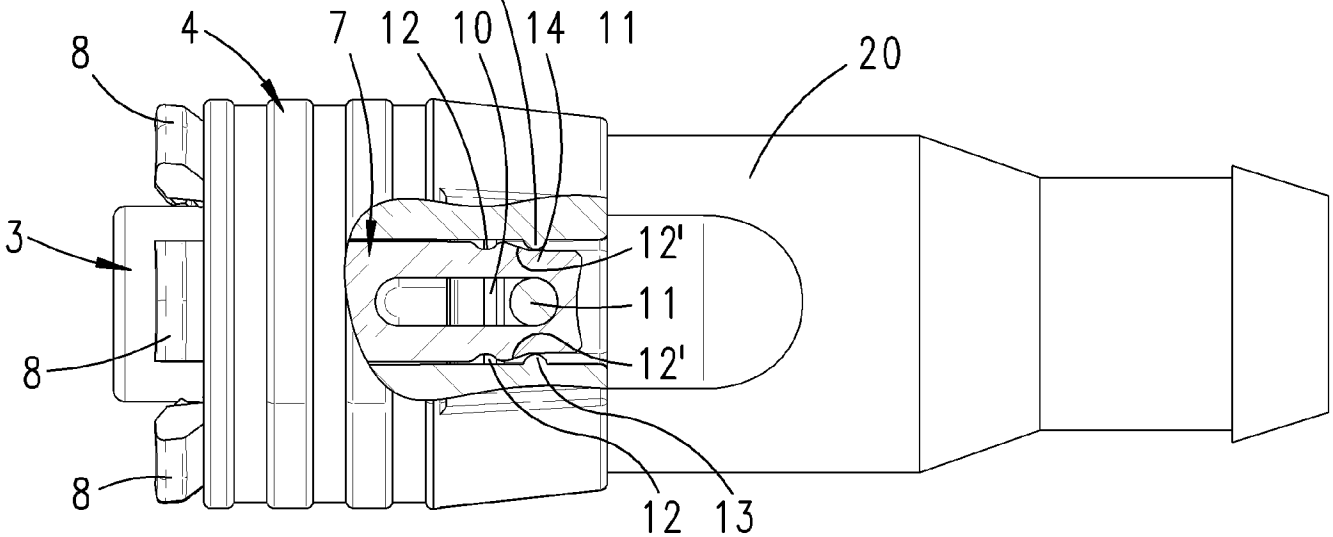
Figure 4:
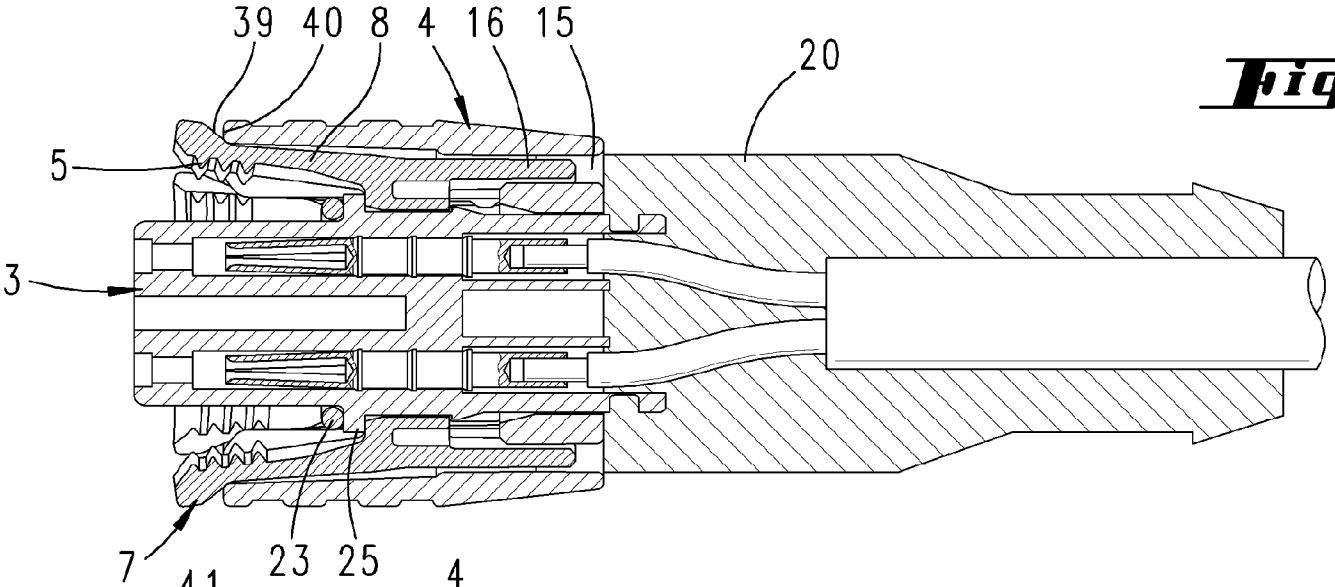
Figure 5:
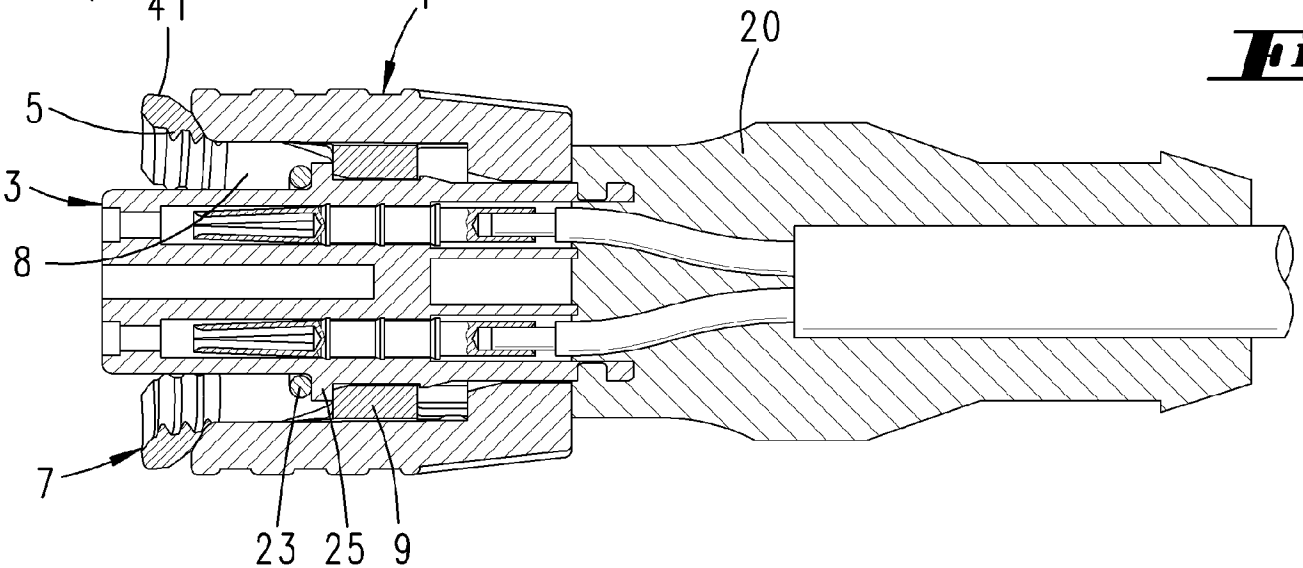
Figure 6:
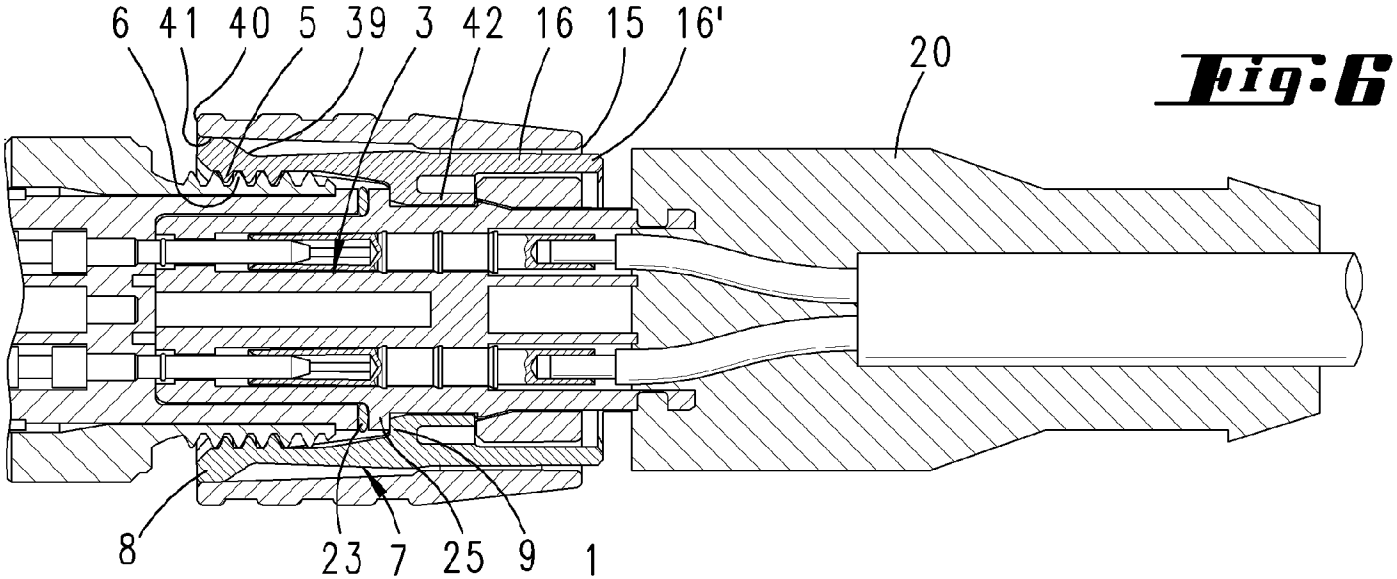
Figure 7:
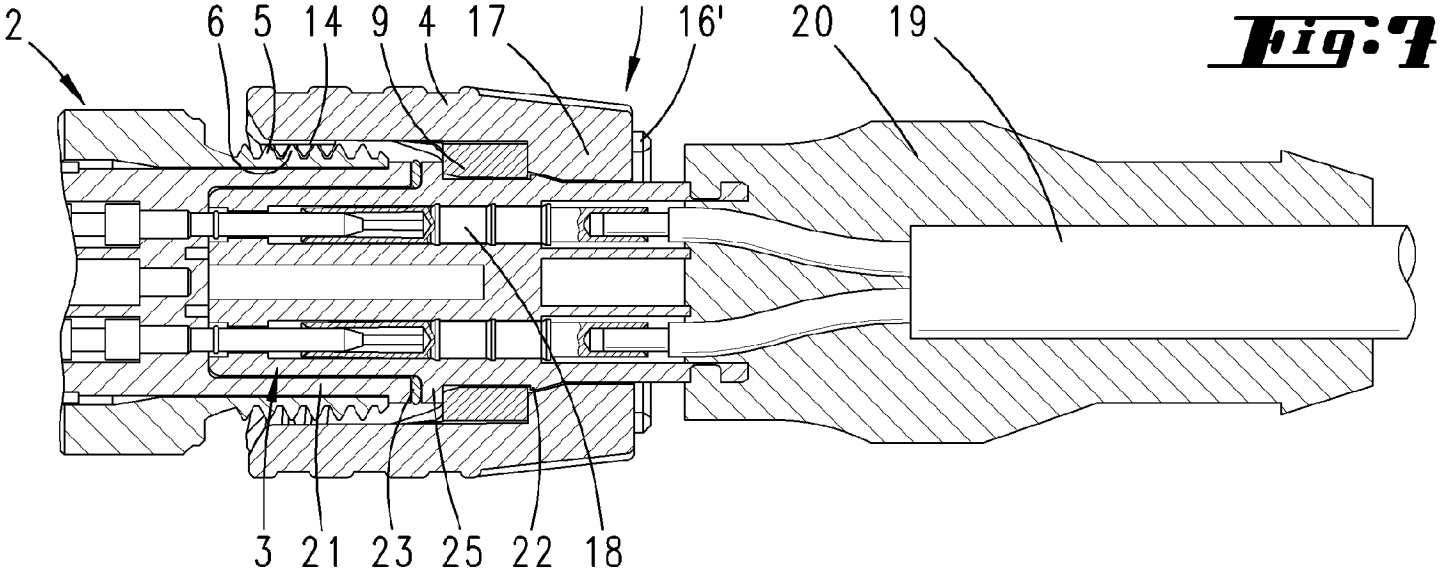
Figures 8, 9:
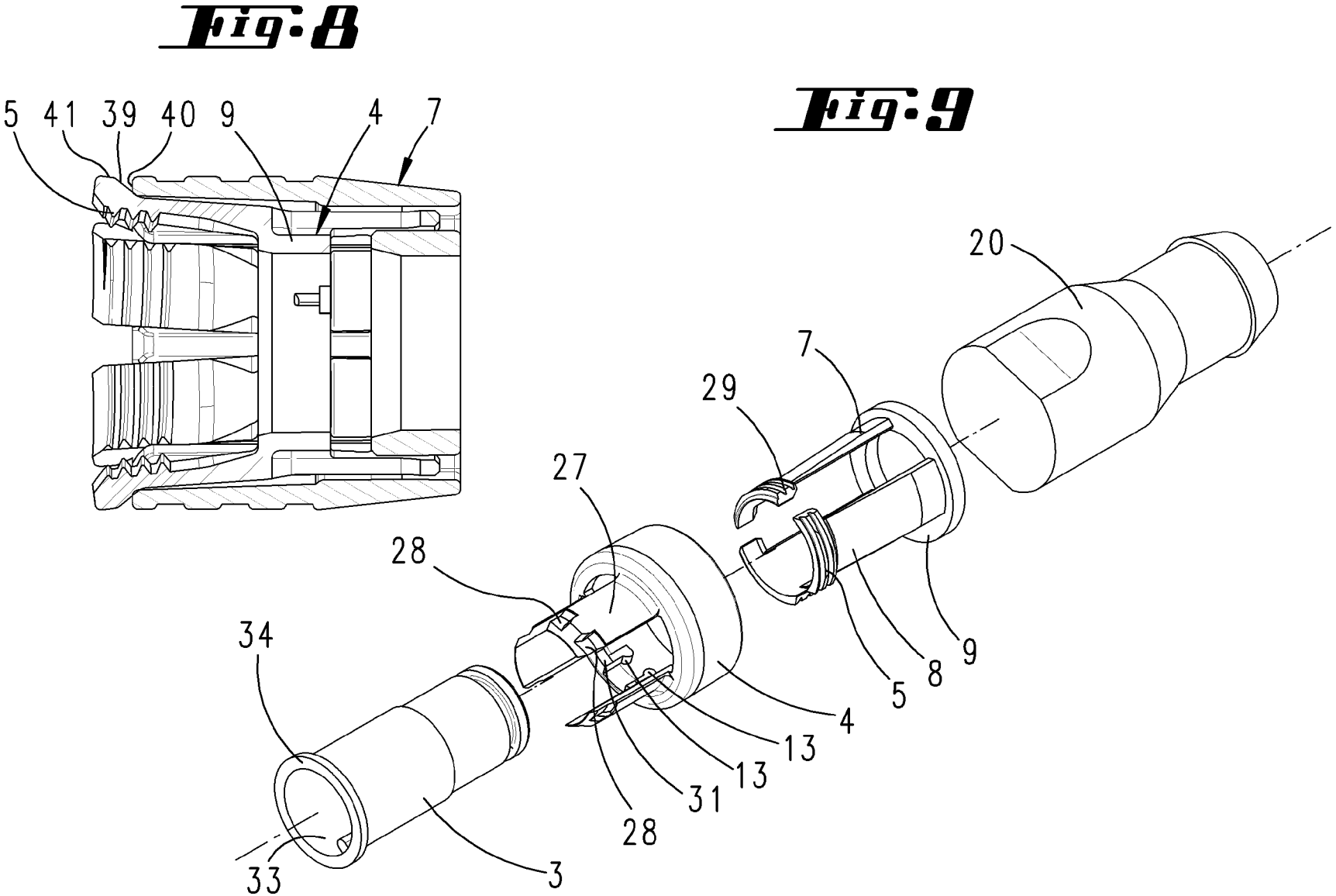
Figures 10, 11, 12:
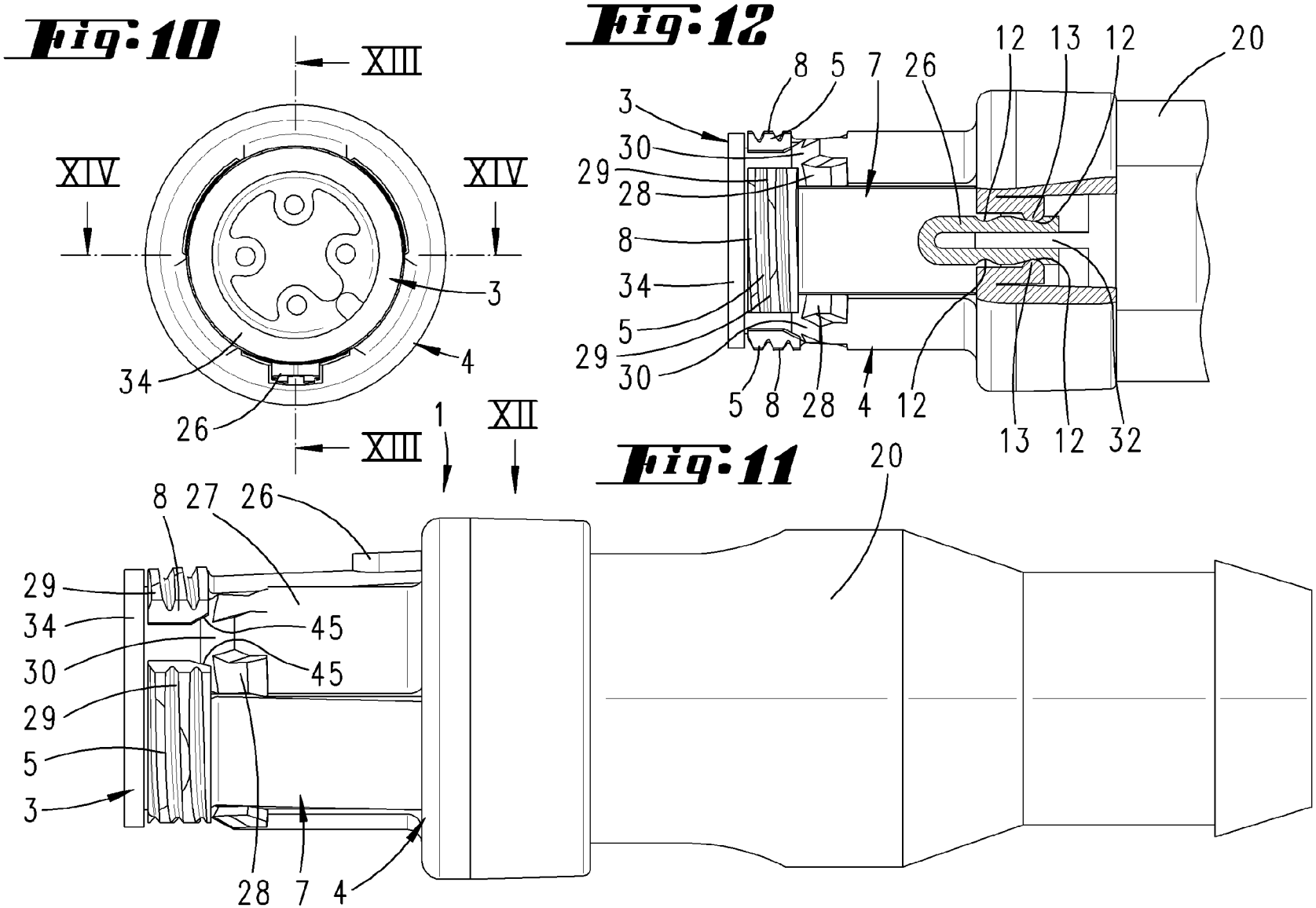
Figure 13:
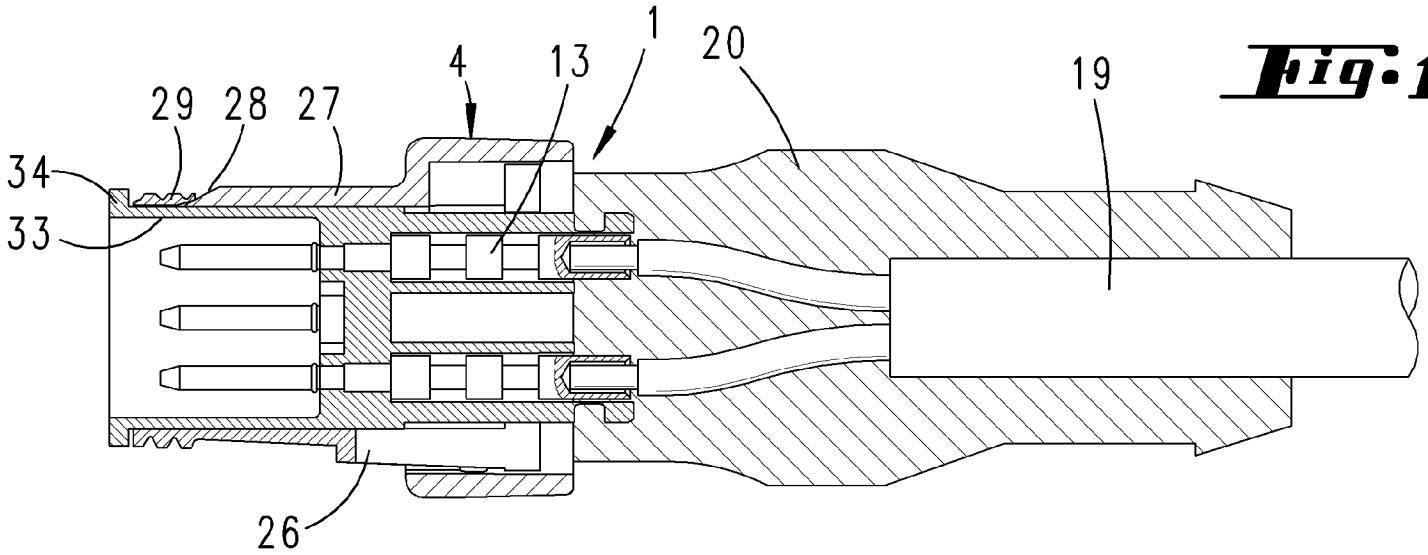
Figure 14:
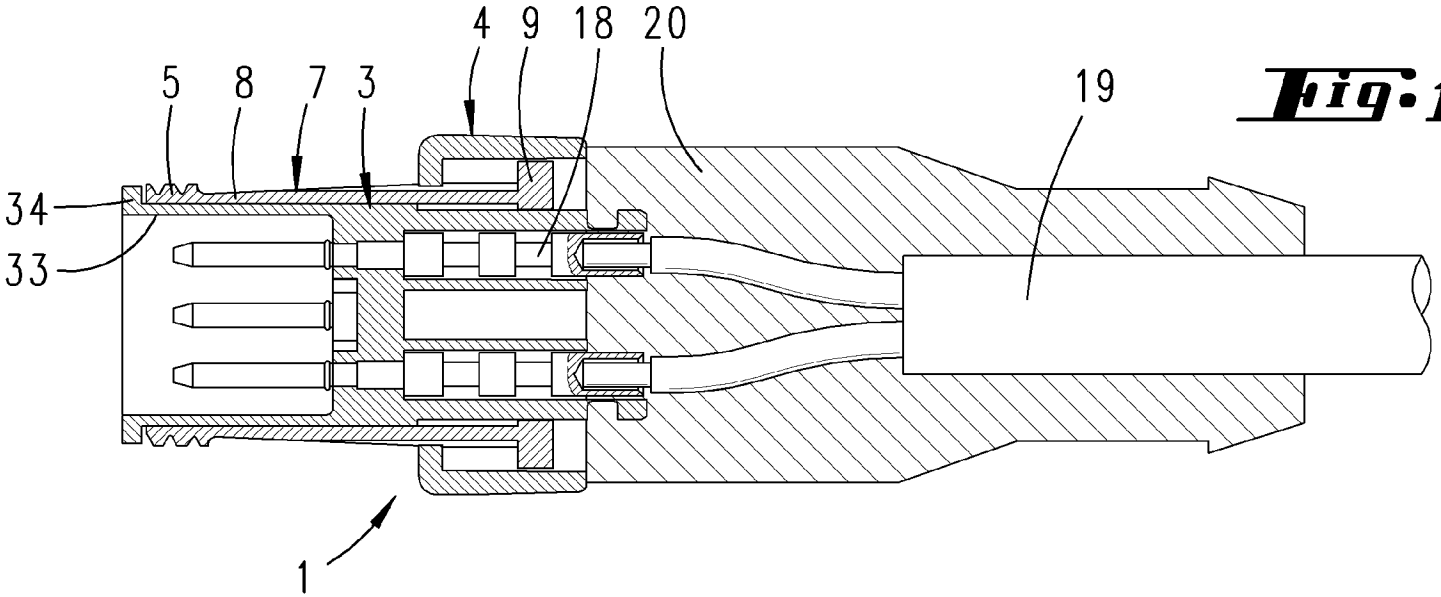
Figure 15:
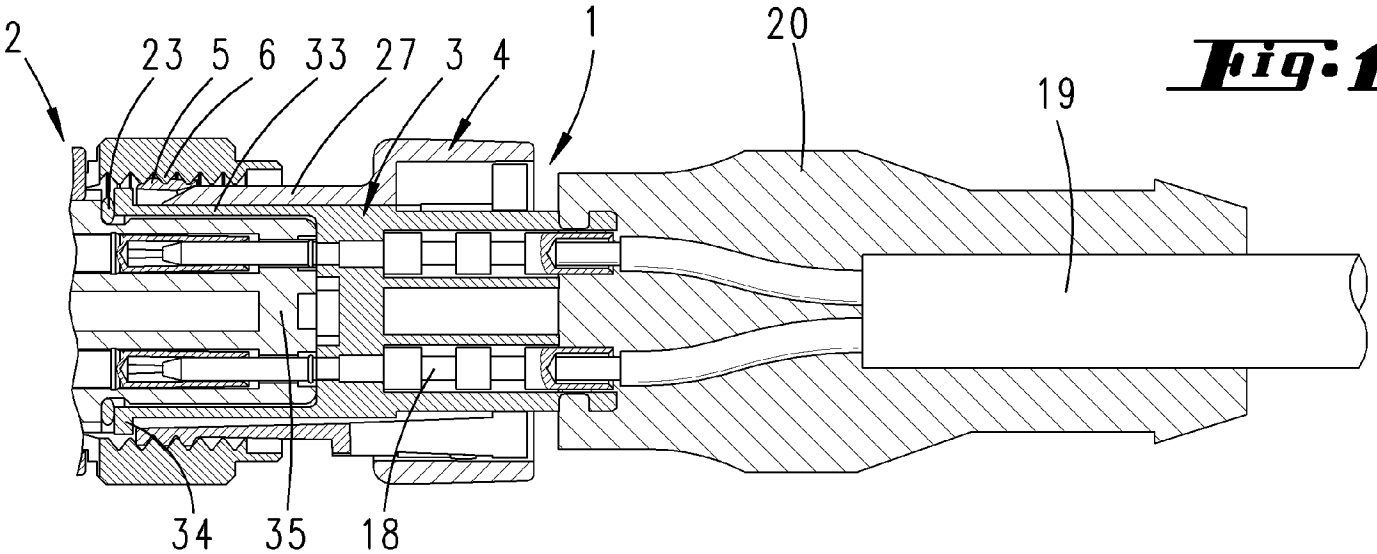
Figure 16:
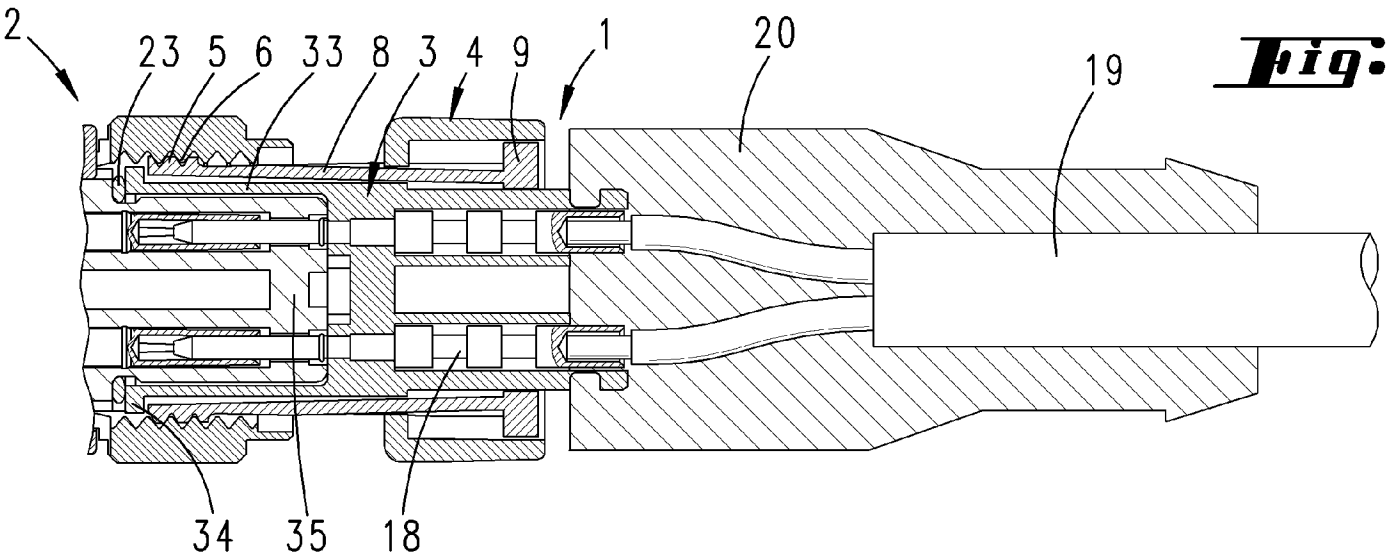
Figure 17:
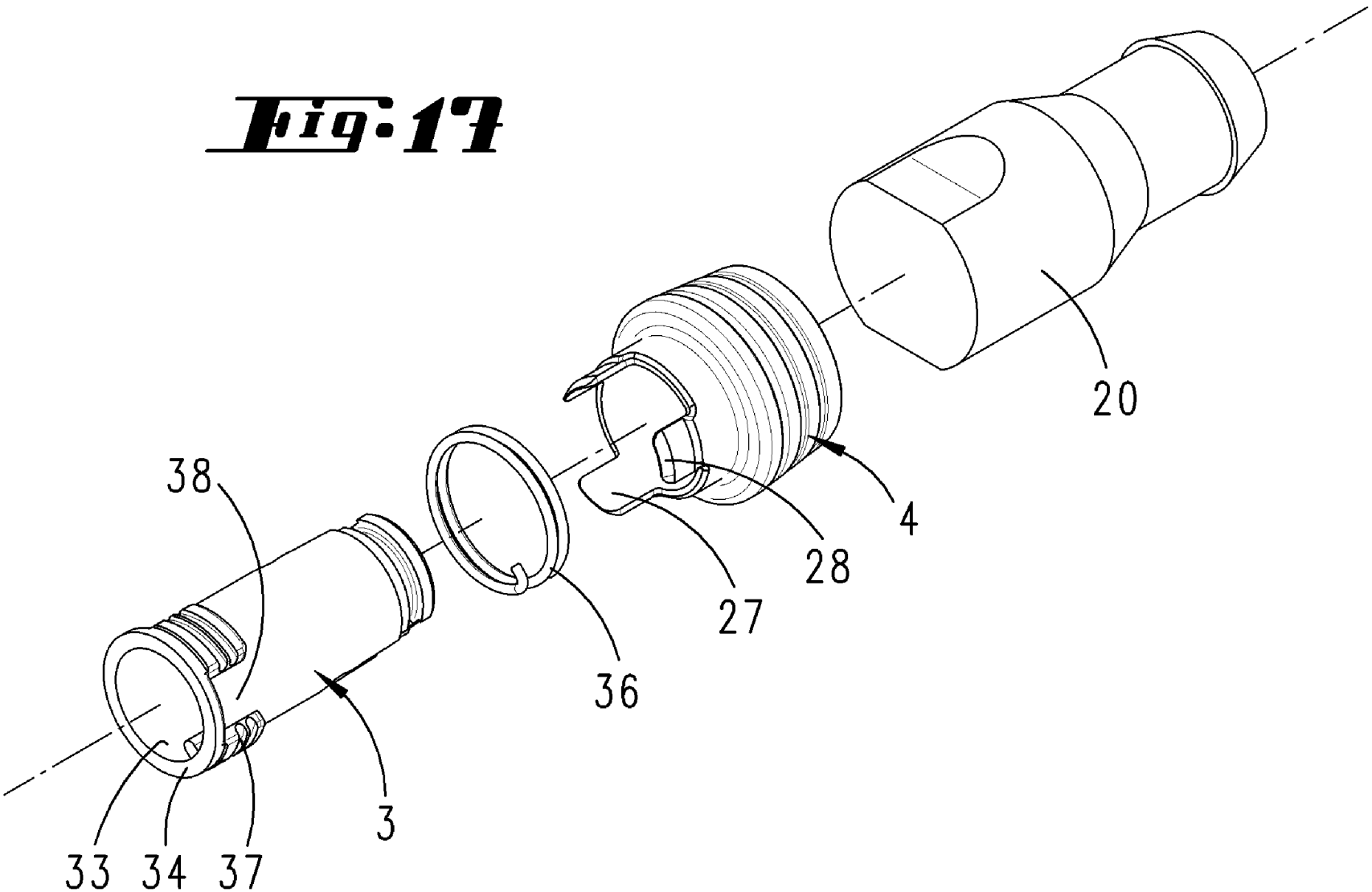
Figure 18:
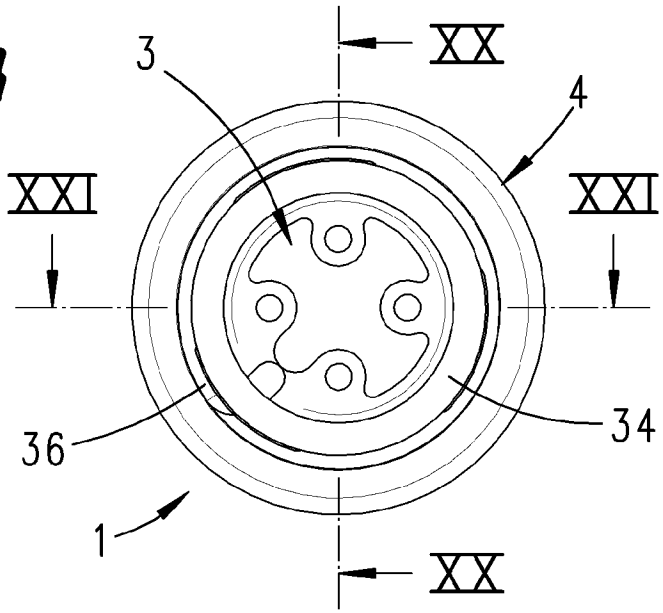
Figure 19:
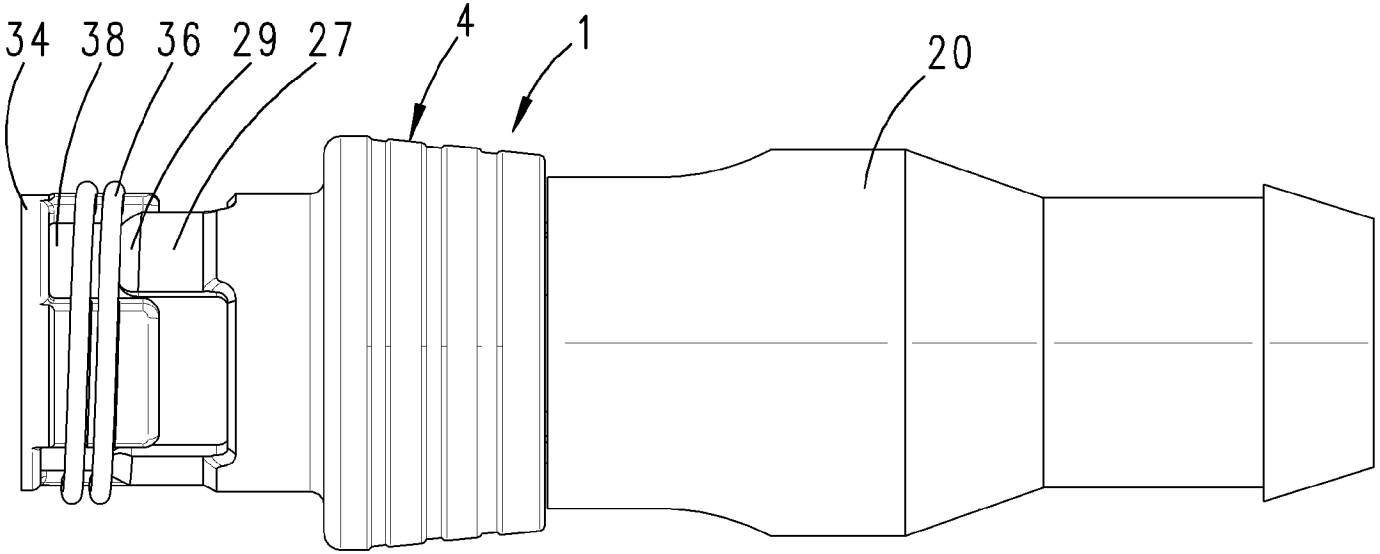
Figure 20:
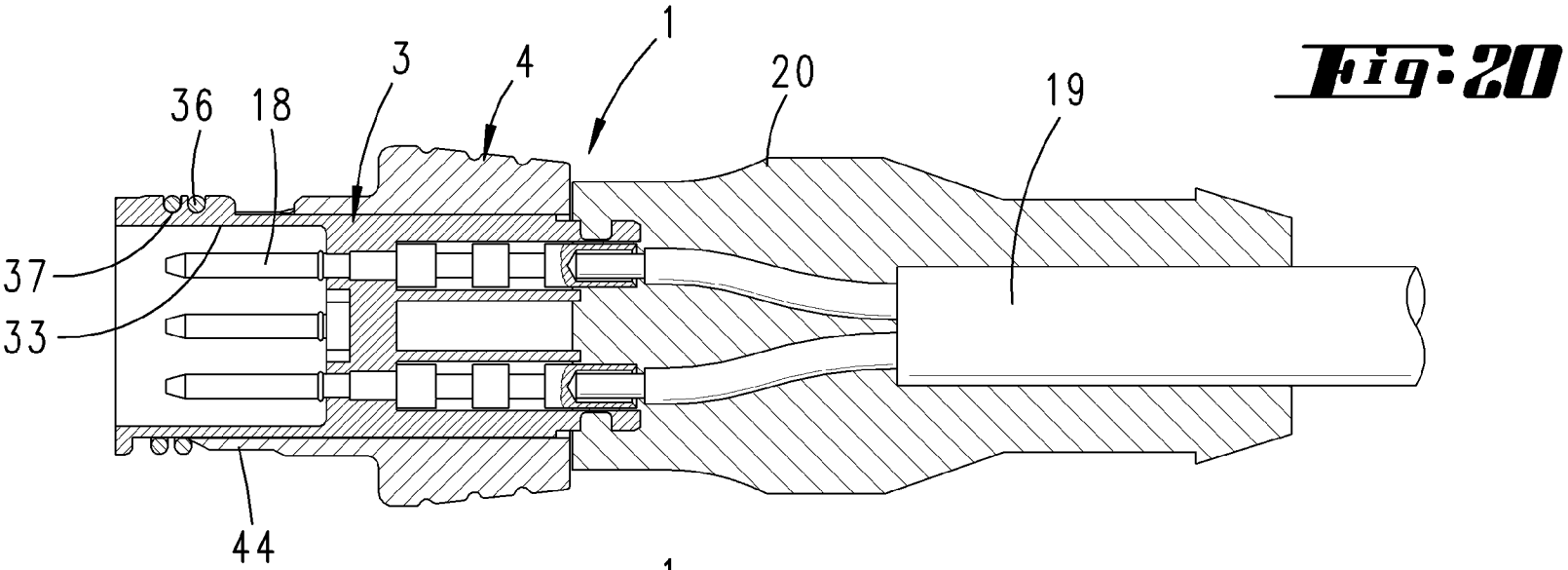
Figure 21:
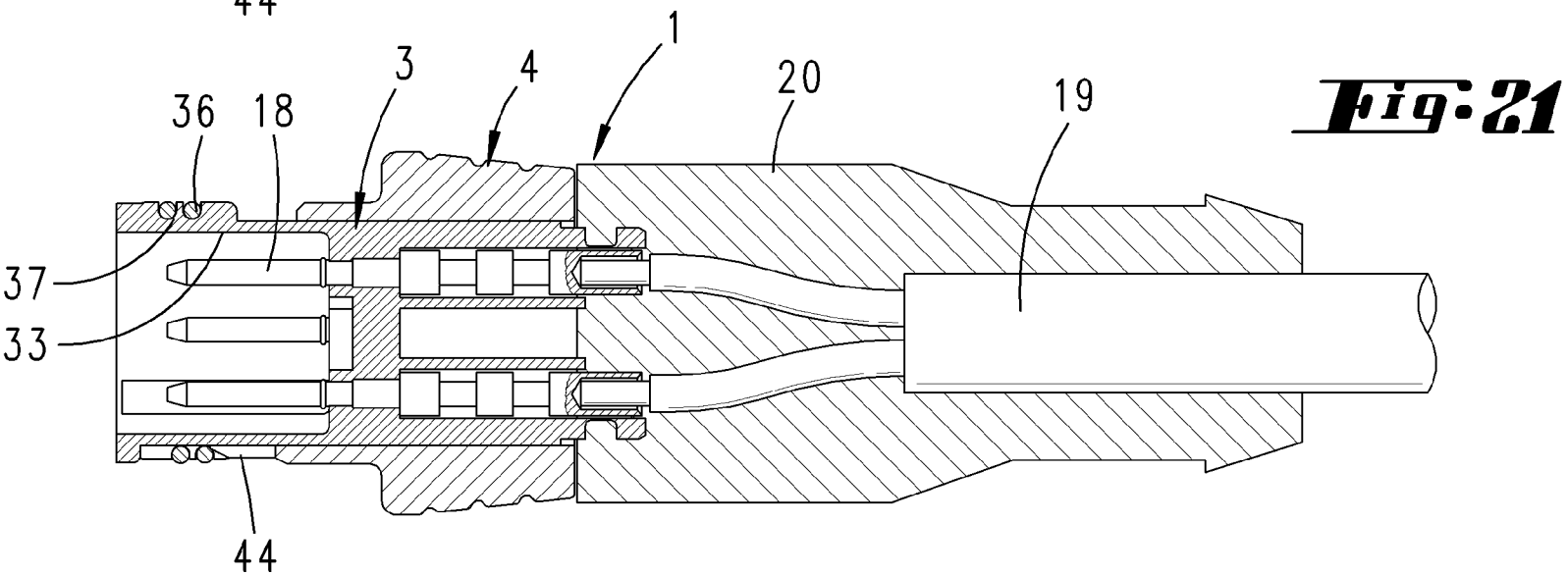
Figure 22:
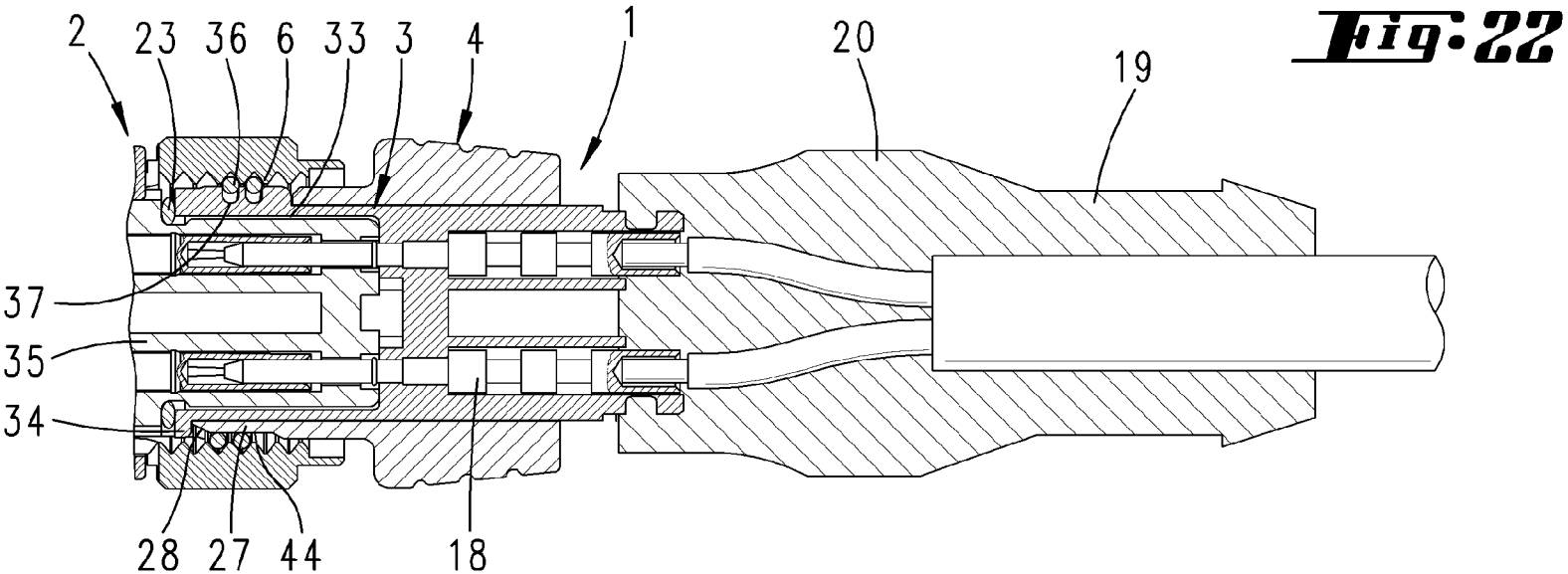
Figure 23:
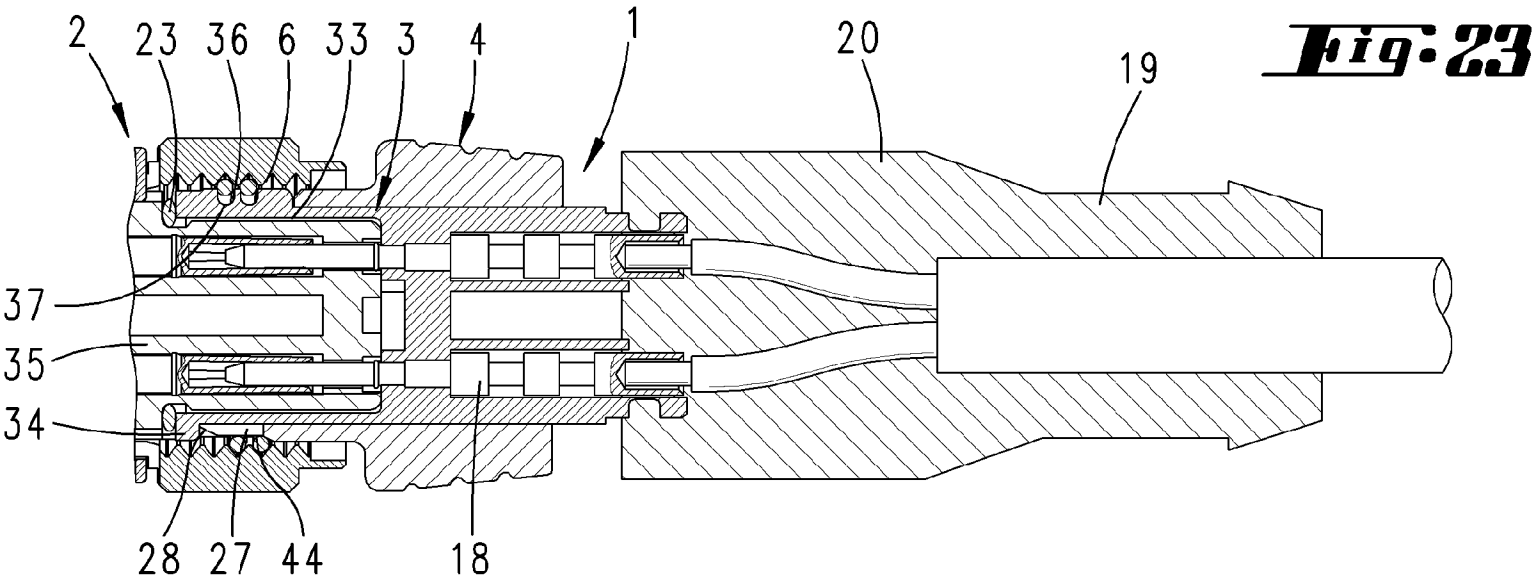

Exemplary embodiments of the invention will be explained below with reference to appended drawings, in which:

FIG. 1 shows an exploded illustration of a connector element of a first exemplary embodiment, FIG. 2 shows an end view of the connector element according to FIG. 1, FIG. 3 shows a side view of the connector element with a partially broken-away actuating sleeve, FIG. 4 shows a section along line IV-IV in FIG. 2, the actuating sleeve being in the released position, FIG. 5 shows a section along line V-V in FIG. 2, likewise in the released position, FIG. 6 shows the illustration according to FIG. 4, but in the locked position, FIG. 7 shows the illustration according to FIG. 5, but in the locked position, FIG. 8 shows a section along line VIII-VIII in FIG. 1 through the actuating sleeve, FIG. 9 shows a second exemplary embodiment of the invention in an exploded illustration, FIG. 10 shows an end view of the connector element of the exemplary embodiment according to FIG. 9, FIG. 11 shows the side view of the connector element according to FIG. 9, FIG. 12 shows a plan view with broken-away actuating sleeve, FIG. 13 shows a section along line XIII-XIII in FIG. 10 in the released position, FIG. 14 shows a section along line XIV-XIV in FIG. 10 in the released position, FIG. 15 shows an illustration according to FIG. 13 in the locked position, FIG. 16 shows an illustration according to FIG. 14 in the locked position, FIG. 17 shows a third exemplary embodiment of the invention in an exploded illustration, FIG. 18 shows an end view of the connector element according to FIG. 17, FIG. 19 shows a side view of the connector element according to FIG. 17, FIG. 20 shows a section along line XX-XX in FIG. 18 in the released position, FIG. 21 shows a section along line XXI-XXI in FIG. 18, likewise in the released position, FIG. 22 shows an illustration according to FIG. 20 in the locked position, and FIG. 23 shows an illustration according to FIG. 21 in the locked position.

The connector element 1 illustrated in FIGS. 1 to 8 has a contact carrier 3 which comprises a plastics part. A large number of contact elements 18, which can be contact-connected to contact elements of a mating connector, are located within the contact carrier 3. The cores of a cable 19 are soldered to the contact elements 18. The rearward region of the contact carrier 3 is surrounded in an interlocking manner by a plastics sheath 20 which seals off the transition to the cable 19. The front region of the contact carrier 3 forms a socket portion which can be inserted into an insertion opening 21 in a mating connector. The wall of the insertion opening 21 of the mating connector 2 has an external thread 6. The external thread 6 can be rotatable, but it can also be fixed.

An actuating sleeve 4 forms a closure element with a thread engagement part 7. This closure element is pushed onto the contact carrier 3. The closure element comprises, in first instance, a thread engagement part 7 which forms a carrying ring 9. A total of six spring tongues 8 which extend in the axial direction are integrally formed on the carrying ring 9. The spring tongues 8 extend in the direction of the free end of the contact carrier 3 and continue in the rearward direction to form push-in projections 16. At their free ends, the spring tongues 8 have thread engagement projections 5. In the exemplary embodiment, the thread engagement projections 5 are directed radially inward. They can engage in a turn of the thread of the abovementioned external thread 6 of the mating connector 2. They therefore have radially inwardly projecting projections which run on a thread contour line.

The rearward push-in projections 16 of the thread engagement part 7 can be inserted into plug-in passages 15 in the actuating sleeve 4 when the thread engagement part and actuating sleeve 4 are connected. A latch is provided in order to hold the actuating sleeve 4 on the thread engagement part 7.

The individual spring tongues 8 are spaced apart from one another in the circumferential direction. Guide ribs 14 of the inner wall of the actuating sleeve 4 engage in this intervening space. One or more side walls of the spring tongues 8 form latching cutouts 12. The side wall of the corresponding guide rib 14 has a latching lug 13 which interacts with the latching cutout 12. The actuating sleeve 4 can be locked in a specific axial position relative to the spring tongue carrier 9 by engagement of the latching lug 13 into an associated latching cutout 12. The actuating sleeve 4 can preferably be locked both in the released position illustrated in FIGS. 4 and 5 and in the locked position illustrated in FIGS. 6 and 7 by way of the thread engagement part 7.

The spring tongue carrier 9 has an annular shape and is pushed from the rear onto the contact carrier 3 which has not yet been connected to the cable 19. During this push-on process, it runs over the sloping portions of a latching step 22 and then, after the entire carrying ring 9 has run over the latching step 22, butts against an annular collar 25 of the contact carrier 3, so that it is secured to the contact carrier 3 in an axially fixed but rotatable manner, on one side by the annular collar 25 and on the other side by the latching step 22.

The manner of operation of this connector element 1 is as follows: the actuating sleeve 4 is in a position which is displaced toward the rear in the released position illustrated in FIGS. 4 and 5. In this position, the rear end surface of the actuating sleeve 4 rests against the plastics sheath 20. In this position, the thread projections 5 project from the socket-defining projection of the contact carrier 3 in such a way that the wall of an insertion opening 21 in a mating plug 2 can be inserted into this wedge-like intermediate space between the spring tongue 8 and the socket-defining projection, until the end outer edge of the insertion opening wall 21 butts against a sealing ring 23 which is situated in front of the annular collar 25. In this operating position, which is not illustrated in the drawings, the actuating sleeve 4 can be displaced in the direction of the mating connector 2. In the process, the end outer edge 40 of the actuating sleeve 4 slides onto a radially outer inclined flank 39 of any spring tongue, and thereby displaces the spring tongue radially inward against the elastic restoring force of the material of the spring tongue 8. For this purpose, the spring tongue 8 consists of a spring-elastic plastics material. In the course of this radially inward displacement, the thread engagement projections 5 of the spring tongue 8 enter the mating thread 6 of the mating connector element 2. In the course of the axial displacement of the actuating sleeve 4, the latching lug 13 leaves an associated latch 12' and overcomes a latching projection of the side flank of the spring tongue 8 in order to then enter the latching cutout 12. In this position, an inner wall portion of the actuating sleeve 4, which inner wall portion adjoins the end outer edge 40, is situated in front of a pressing flank 41 of the end of the spring tongue 8 and holds said spring tongue in an interlocking manner in the radially inwardly curved position in which the thread engagement projections 5 have entered the mating thread 6.

If, starting from this plug-connected locked operating position, the actuating sleeve 4 is now rotated, this acts like an internally threaded sleeve. The thread engagement of the thread engagement projections 5 into the mating thread 6 creates a screw force when the actuating sleeve 4 is rotated, said screw force leading to the outer edge of the insertion opening wall 21 being pressed against the sealing ring 23. Said sealing ring is compressed until the locked position illustrated in FIGS. 6 and 7 has been assumed.

As shown in FIG. 1, the inner wall of the spring tongue carrier 9 rests on a toothed portion 24 of the contact carrier 3. The spring tongue carrier 9 has, at the point denoted 42 in FIG. 6, a radially inwardly projecting spring element 42 which engages in the tooth system 24 in an elastically reversible manner. When the actuating sleeve 4 is rotated, the spring element 42 runs over the teeth of the tooth system 24. The engagement of the spring element into a tooth gap in the tooth system 24 provides security against shaking.

In FIG. 3, reference numeral 11 indicates an optional pin which engages in an optional longitudinal groove in one spring tongue 8. The pin projects from the inner wall of the actuating sleeve 4. This pin 11 is not essential. It merely forms a stop limit for the axial displacement of the actuating sleeve 4. The longitudinal groove 10 into which the pin 11 engages and which is formed by a spring tongue 8 can likewise be dispensed with. The spring tongues 8 form, together with their rearward projections 16, a rocker-like arrangement, the rocker joint being formed by the annular release tongue carrier 9. In the released position illustrated in FIGS. 4 and 5, the insertion projection 16 is inserted substantially freely into the plug-in passage 15 in the actuating sleeve 4. If the actuating sleeve 4 is displaced into the locked position illustrated in FIGS. 6 and 7, the end outer edge 40 slides on the inclined flank 39 of the spring tongue. This results in the spring tongue 8 being pivoted in the radial direction. Since the spring tongue 8 is connected to the insertion projection 16 in a substantially rigid manner, the insertion projection 16 pivots in a corresponding manner until it abuts against the inner wall of the actuating sleeve 4. This abutment position is not illustrated in FIG. 6 but is reached just the same. If the abutment position is reached, the bending bar formed by spring tongues 8 and the insertion projection 16 bends elastically. The spring tongue 8 therefore forms, together with the insertion projection 16, a leaf spring-like bending body which bends about the carrying ring 9.

As can be seen in FIG. 4, the insertion projection is, in the released position, located beneath the actuating sleeve 4 in a manner which is not visible from the outside. If the actuating sleeve is displaced into the locked position illustrated in FIG. 6, the rear edge portion 16' is visible. This edge portion 16' therefore forms an indicator zone which indicates that the actuating sleeve 4 has been correctly moved into the locked position. The cage-like body which forms the spring tongues and the push-in projections 16 preferably has a high-contrast color, for example green.

The second exemplary embodiment illustrated in FIGS. 9 to 16 has a contact carrier 3 which has an insertion opening 33 for a mating connector element 2 which forms a corresponding insertion socket portion 35. In this case also, the closure element is of two-part form and comprises an actuating sleeve 4 and a thread engagement part 7. The thread engagement part 7 also has a plurality of spring tongues 8 in this case. The total of three spring tongues 8, which are uniformly distributed over the circumference and extend in the axial direction, are integrally fixed to an annular spring tongue carrier 9. One of the spring tongues 8 forms an axial slot 32 in the region of the spring tongue carrier 9. The spring tongue carrier is likewise slotted for this purpose. The slot 32 is surrounded at its edge by a U-shaped latching rib 26. The two circumferential flanks of the latching rib 26 which point away from one another form adjacent latching cutouts 12, 12'. On account of the slot 32, the two U-limbs of the latching rib 26 can move slightly toward one another.

The actuating sleeve 4 has axially protruding actuating arms 27. A total of three actuating arms 27 are provided, said actuating arms being situated in the intermediate spaces of the spring tongues 8 which are spaced apart from one another in the circumferential direction. In the region of an intermediate space between two actuating arms 27, the inner wall of the actuating sleeve 4 has guide webs 31 between which the U-shaped latching rib 26 is situated. Latching lugs 13 project from the two correspondingly spaced-apart guide webs 31. The latching lugs 13 protrude from the guide webs 31 in a manner directed toward one another in such a way that they can enter the two adjacent latching cutouts 12, 12' of the latching rib 26.

The actuating sleeve 4 can be displaced in the axial direction in relation to the thread engagement part 7, the two displacement positions being fixed by engagement of the two latching lugs 13 into the respective latching cutouts 12, 12'.

The end faces of the actuating arms 27 have two inclined surfaces 28 which are each disposed at the edge and which form lifting surfaces. The end face of each actuating arm 27 forms a wedge piece 30 between the two lifting surfaces 28.

Arcuate pieces are located at the free ends of the spring tongues 8. These arcuate pieces form the thread engagement projections 5. The thread engagement projections 5 run on the contour line of a thread in this exemplary embodiment also. Said thread is an external thread. The arcuate pieces protrude beyond the actuating arms 27 in the circumferential direction and in each case form protrusions. The inner walls of the protrusions 29 are formed with bevels 43. These bevels correspond to the lifting surfaces 28 of the actuating arms 27. An end collar 34 of the contact carrier 3 is located in front of the head of the spring tongues 8, immediately adjacent to the thread engagement projections 5.

In this exemplary embodiment also, a rearward end of the contact carrier 3 is connected to a plastics sheath 20 in an interlocking and sealed manner. The plastics sheath 20 extends over the contact region of the cores of the cable 19 having the contact elements 18 which are located in the contact carrier 3.

The annular carrying ring 9, from which the spring tongues 8 start, is located in an internal hollow portion of the actuating sleeve 4. The actuating sleeve 4 can be displaced over this carrying ring 9 in the axial direction. The spring tongue carrier 9 and the thread engagement part 7 which forms it are associated with the contact carrier 3 in a rotatable but axially fixed manner.

The manner of operation of this connector element is as follows:

The released position illustrated in FIGS. 13 and 14, the spring tongues 8 and the thread engagement projections 5 carried by said spring tongues rest on the outer wall of the cylindrical contact carrier 3 and therefore assume a position which is displaced back in the radial direction. In this operating position, a socket portion 35 of a mating connector element can be inserted into the insertion opening 33 of the connector element 1. An internal thread part which surrounds the socket portion 35 at a distance and has a mating thread 6 is displaced above the thread projections 5 in the process. The distance between the mating thread and the outer wall of the socket portion is of appropriate magnitude. This axial plug-connection movement is terminated when the end surface formed by the end collar 34 strikes a sealing ring 23 of the mating connector element 2. The actuating sleeve 4 can then be displaced onto the mating connector element in the axial direction. In the process, the beveled lifting surfaces 28 pass beneath the protrusion portions 29 of the arcuate pieces which form the thread engagement projections 5. The protrusion portions 29 form bevels 43 for this purpose, and the lifting surfaces 28 can slide on said bevels. During the course of the axial displacement of the actuating sleeve 4, the latching lug 13 leaves its associated latching cutout 12'. The wedge piece 30 passes between the two circumferential end surfaces of two adjacent arcuate pieces in order to drive said arcuate pieces away from one another so as to increase the circumference. The inclined flank 28 of the actuating arm 27 runs beneath the inclined flank 45 of the protrusion 29 of the arcuate piece in this case. This leads to radial displacement of the arcuate piece. In association with this radial displacement of the spring-elastic spring tongues 8 in the radially outward direction, the thread engagement projections 5 enter the corresponding turns of the mating thread 6, until the actuating sleeve 4 has reached its end position which is illustrated in FIGS. 15 and 16 and in which the latching lug 13 has entered its associated latching cutout 12.

In this position, the actuating sleeve 4 can be rotated. It then acts like a threaded sleeve and generates a screw force which results in compression of the sealing ring 23. As also occurs in the case of the first exemplary embodiment, the connector element 1 and the mating connector element 2 are separated by merely axial return displacement of the actuating sleeve from its locked position to its released position. During the course of this return displacement, the thread engagement projections 5 disengage from the turns of the mating thread 6. This occurs as a result of the return capability of the spring tongues 8. In the end phase of this axial return displacement of the actuating sleeve 4, said actuating sleeve locks in relation to the thread engagement part 7. The connector parts 1, 2 can be separated from one another on account of the absence of interlocking thread engagement.

Axially displaceable thread engagement projections 5 are likewise provided in the third exemplary embodiment which is illustrated in FIGS. 17 to 23. However, in contrast to the preceding exemplary embodiments, these thread engagement projections are formed by a helical spring 36. The contact carrier 3 consists of plastics and has an end collar 34 which surrounds an insertion opening 33 for the socket portion of a mating connector element 2. The contact carrier 3 has a total of three profile portions, which are spaced apart from one another in the circumferential direction, immediately to the rear of the end collar 34. Each of these three profile portions forms retaining or bearing grooves 37 for the helical turns of the helical spring 36. The bearing grooves 37 are formed to be deep, in such a way that the helical turns of the helical spring 36 can enter said bearing grooves substantially completely.

In this exemplary embodiment, the actuating sleeve 4 is likewise disposed such that it can be displaced on the contact carrier part. Said actuating sleeve can be displaced from a released position, which is illustrated in FIGS. 20 and 21, to a locked position, which is illustrated in FIGS. 22 and 23. The actuating sleeve is also held in the two operating positions by a locking means, said locking means not being illustrated in the drawings however.

In this case, the locking can take the form shown in FIG. 3. A pin 11 which projects from the inner wall of the actuating sleeve can engage in a longitudinal groove which is associated with the contact carrier 3. The longitudinal groove may have a kidney shape, so that latching has to be overcome within the longitudinal groove 10 when the pin 11 is displaced.

The actuating sleeve 4 has a total of three actuating arms 27 which are spaced apart from one another in the circumferential direction and which extend in the axial direction. The free ends of the actuating arms are beveled and form lifting surfaces 28.

In the released position illustrated in FIGS. 20 and 21, the lifting surfaces 28 are situated in front of the helical turns of the helical spring 36 which are situated in the bearing grooves 37. If the actuating sleeve 4 is displaced in the direction of the mating connector element 2, the lifting surfaces 28 engage beneath the helical spring 36 in such a way that said helical spring is widened and the helical turns of said helical spring disengage from the recesses in the bearing groove 37. The helical turns are lifted out of the groove 37 on account of the sloping lifting surface 28 engaging beneath the helical turns in a blade-like manner. Portions of the helical spring 36 then enter a mating thread 6 of a mating connector element. In the locked position, an outer wall 44 of the actuating arms 27 is situated beneath the helical spring 36. The outer walls 44 of the actuating arms 27 lie on a cylindrical lateral surface.

All disclosed features are (in themselves) pertinent to the invention. The disclosure content of the associated/accompanying priority documents (copy of the prior application) is also hereby incorporated in full in the disclosure of the application, including for the purpose of incorporating features of these documents in claims of the present application.

The invention claimed is:

1. Connector element of an electrical plug-in connection having a contact carrier which has one or more electrical contacts, an actuating sleeve which surrounds the contact carrier, and having a thread engagement part having one or more thread engagement projections for entry into a mating thread of a mating connector element, it being possible to move the actuating sleeve from a released position, in which the thread projections do not engage in the mating thread and the connector element can be connected to the mating connector element, into a locked position, in which the thread projections engage in the mating thread and the connector element is secured to the mating connector element, the actuating sleeve having actuating arms and lifting surfaces being provided, in order to move the thread engagement projections into the thread engagement position when the actuating sleeve is displaced, wherein the lifting surfaces are provided on the actuating arms, which actuating arms are disposed between spring tongues which carry the thread projections, the actuating sleeve being rotatably disposed on the contact carrier together with a spring tongue carrier which carries the spring tongues.

2. Connector element according to claim 1, having at least three actuating arms which are uniformly distributed in the circumferential direction.

3. Connector element according to claim 1, wherein the thread engagement projections are formed by arcuate pieces which are integrally formed at the ends of the spring tongues.

4. Connector element according to claim 1, wherein inclined surfaces of the actuating arms engage beneath the edges of the arcuate pieces.

5. Connector element according to claim 1, having wedge pieces which slide between two arcuate pieces when the actuating sleeve is displaced into the locked position.

6. Connector element according to claim 1, wherein the thread engagement projections have protrusions which project beyond the spring tongues laterally in the circumferential direction and beneath which the lifting surfaces move.

7. Connector element according to claim 1, wherein the actuating sleeve is associated with the spring tongue carrier in a rotationally fixed but axially displaceable manner.

8. Connector element according to claim 1, wherein the spring tongue carrier is merely rotatably associated with the contact carrier.

9. Connector element according to claim 1, having a first latching position in which the actuating sleeve is held in the released position.

10. Connector element according to claim 1. wherein a spring tongue forms an axial slot in the region of the spring tongue carrier, said axial slot being surrounded at its edge by a U-shaped latching rib which forms latching cutouts, latching lugs of the actuating sleeve entering said latching cutouts.

* * * * *